US005694997A

United States Patent [19]

Styger

[11] Patent Number: 5,694,997

[45] Date of Patent: Dec. 9, 1997

[54] GRAVITY EXHIBITION STAND

[76] Inventor: John Errol Styger, 28A Gibson Drive, Euccleuch, Sandton, Transvaal, South Africa

[21] Appl. No.: 238,731

[22] Filed: May 5, 1994

[30] Foreign Application Priority Data

May 5, 1993 [ZA] South Africa ..... 93/3147

[51] Int. Cl.[6] ..... A47G 5/00

[52] U.S. Cl. ..... 160/135; 52/585.1; 52/272; 403/386

[58] Field of Search ..... 160/135, 351; 52/585.1, 587.1, 271, 266, 272; 403/386, 388

[56] References Cited

U.S. PATENT DOCUMENTS

| | | | |
|---|---|---|---|
| 3,809,142 | 5/1974 | Bleeker | 160/135 |
| 4,047,342 | 9/1977 | Boulva | 52/239 |
| 4,121,645 | 10/1978 | Behr | 160/135 |
| 4,516,619 | 5/1985 | Hasbrouck | 160/135 |
| 4,653,563 | 3/1987 | Bannister | 160/135 |
| 4,860,812 | 8/1989 | DePietro et al. | 160/135 |

FOREIGN PATENT DOCUMENTS

| | | | |
|---|---|---|---|
| 0367857 | 5/1990 | European Pat. Off. | E04B 2/74 |
| 878710 | 11/1961 | France | 160/135 |
| 972458 | 10/1964 | United Kingdom | 160/135 |

*Primary Examiner*—Blair Johnson
*Attorney, Agent, or Firm*—Michael D. Bednarek; Kilpatrick Stockton LLP

[57] ABSTRACT

Disclosed is an exhibition stand comprising a plurality of panels having side edges and openings adjacent a pair of opposite side edges, the panels being arranged vertically with said pair of opposite side edges vertical and in two or more rows and two or more columns, a plurality of connector units connecting together the panels, at least some of the connector units comprising an intermediate member having a plurality of apertures therethrough and at least two pins projecting therefrom, each pin comprising two pin parts releasably connected to one another and passing through a said aperture.

7 Claims, 7 Drawing Sheets

GRAVITY EXHIBITION STAND

This invention relates to exhibition stands.

FIELD OF THE INVENTION

The invention is concerned with a demountable exhibition stand that comprises a plurality of panels which in use are mounted vertically in vertical columns and horizontal rows and which for storage and transport can be removed from one another and be laid flat one upon the other. Each panel comprises a pair of vertical edging members and a panel part therebetween. The edging members have vertical end openings. The adjacent panels of a column are connected together by pins which enter into the openings in the edging members. The columns of panels are connected together by connector units consisting of intermediate members in the form of connectors which connect together the pins entering the openings in the edging members of adjacent pairs of panels. These connectors may be arranged to connect together two or more pins located side by side depending upon how many panels in a single row join at that position. The end openings at the edging members at the outer ends of the end columns of panels (i.e. the column of panels at the ends of a row of panels) receive pins which hold these ends together, there being an intermediate member on each such pin in the form of a stop to prevent the pin entering too deeply into the lower opening. An exhibition stand as described in this paragraph is hereinafter called "an exhibition stand of the kind set forth".

SUMMARY OF THE INVENTION

According to one aspect of the invention there is provided a connector unit for use in an exhibition stand of the kind set forth, the pin comprising two parts connectable together in aligned disposition with space therein to contain between them an intermediate member. The two parts preferably have complimentary screw-threaded parts to connect them together. The connection is preferably such that the pin, when the parts are connected do not project beyond the pin.

According to another aspect of the invention there is provided a connector unit comprising the combination of a pin as set forth in the preceding paragraph with an intermediate member secured thereto.

According to a further aspect of the invention there is provided an exhibition stand of the kind set forth including connector units as set forth above joining the panels.

Embodiments of the invention will now be described by way of example with reference to the accompanying drawings.

SHORT DESCRIPTION OF DRAWINGS

Figure 5A:
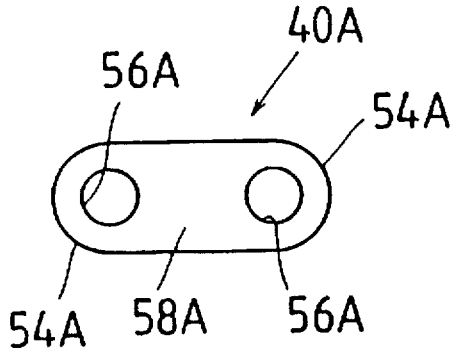
Figure 5B:
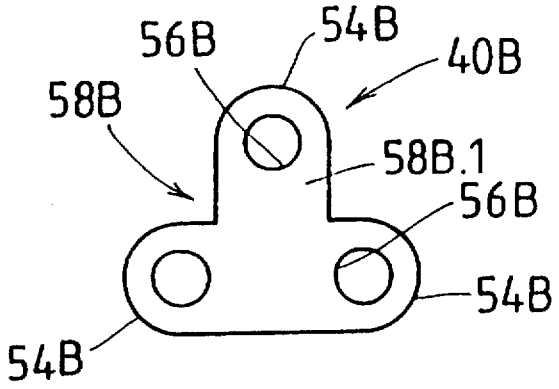
Figure 5C:
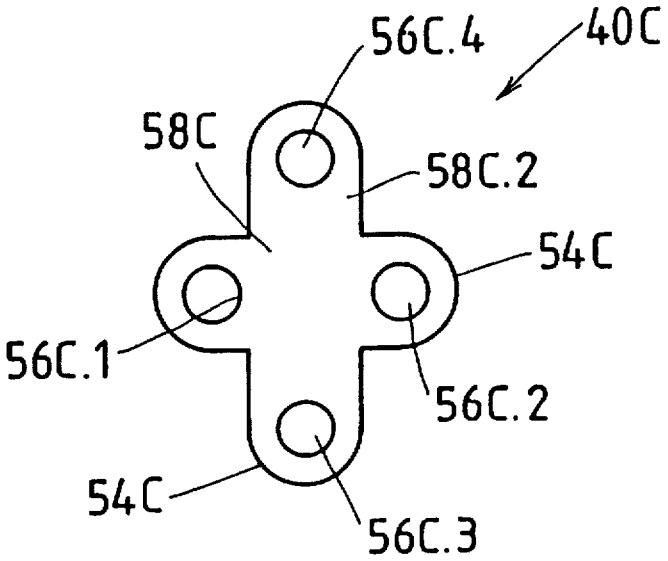
Figure 6:
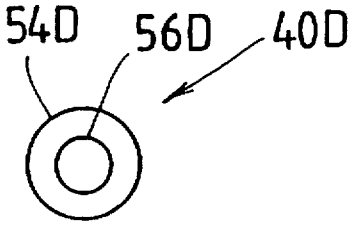
Figure 7:
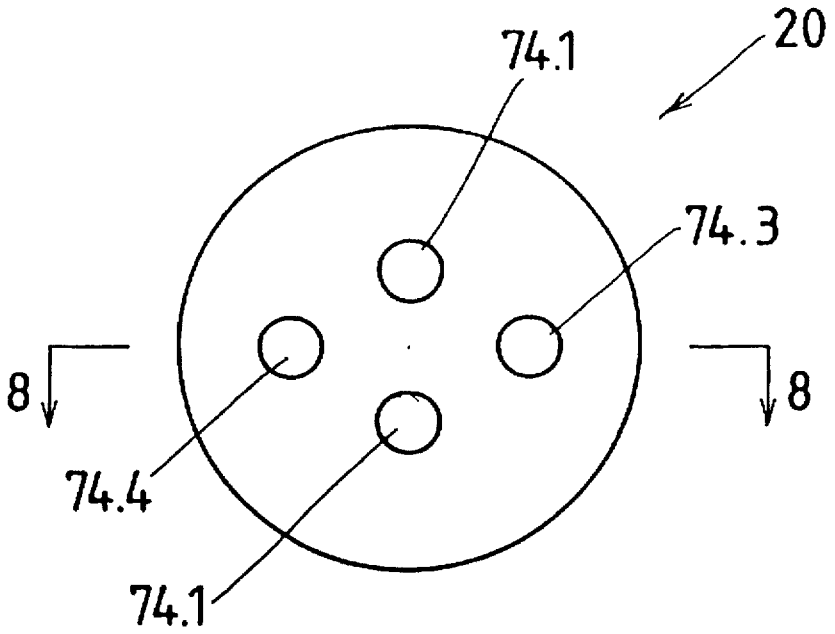
Figure 8:
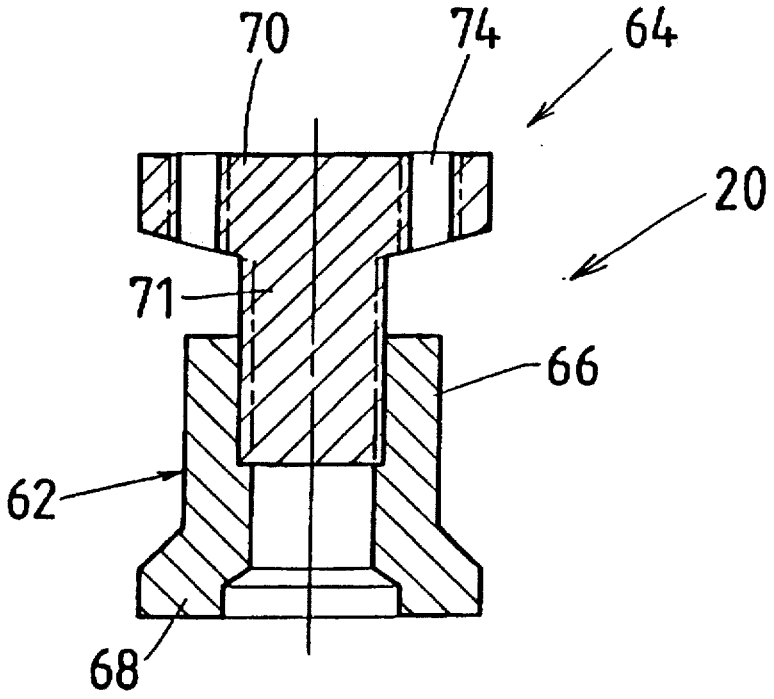

FIGS. 5A, 5B, and 5C are a plans of intermediate members in the forms of connectors, FIG. 6 is a plan of an intermediate member for the end penal of a row, FIG. 7 is a plan of a foot for the exhibition stand, FIG. 8 is a section on line 8—8 of FIG. 7, and FIGS. 9A, 9B and 9C are plans of other arrangements of the exhibition stand.

DESCRIPTION OF THE PREFERRED EMBODIMENT

Figure 1:
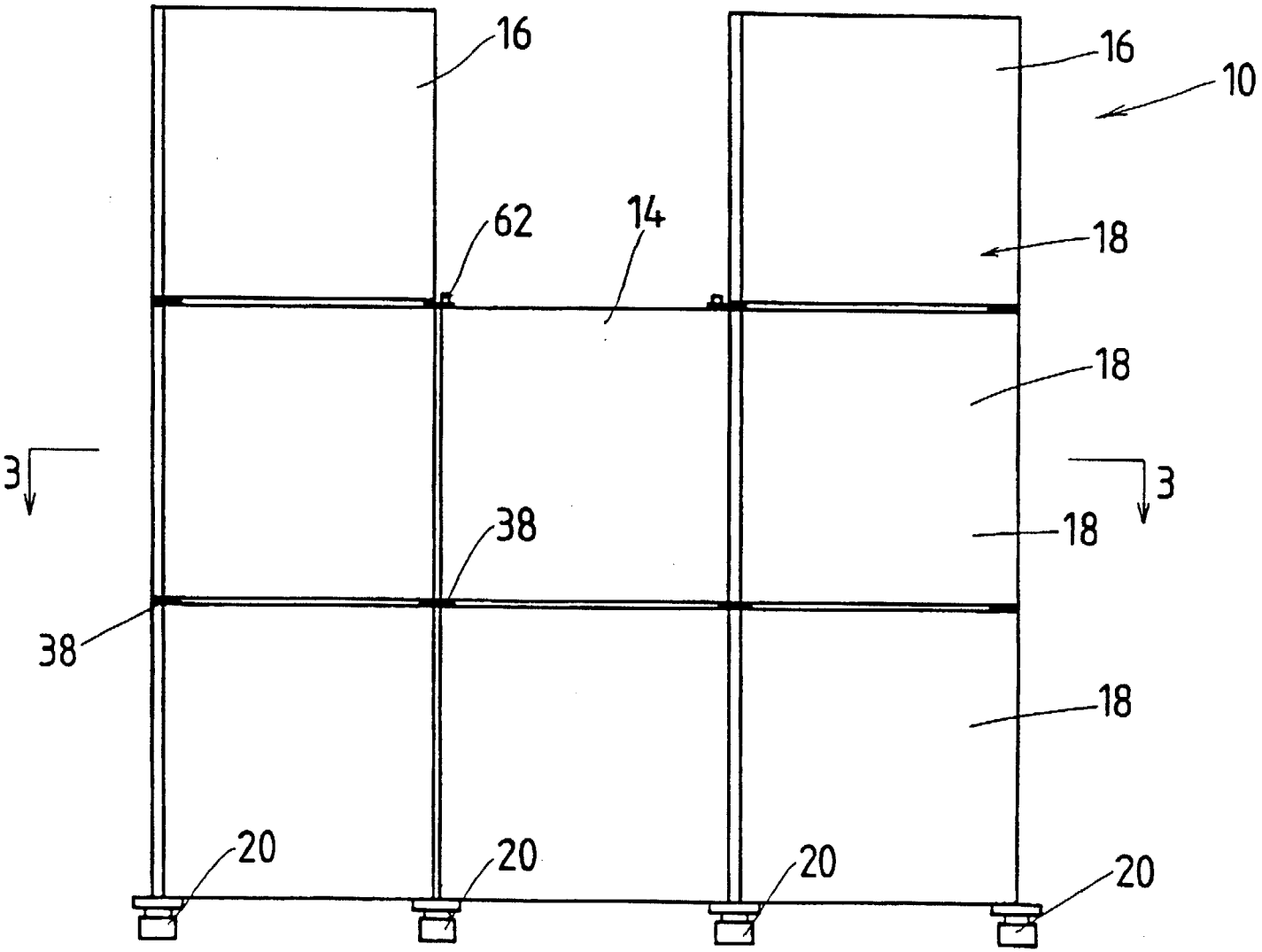
FIG. 1 is a front view of an exhibition stand of the invention.
Figure 2:
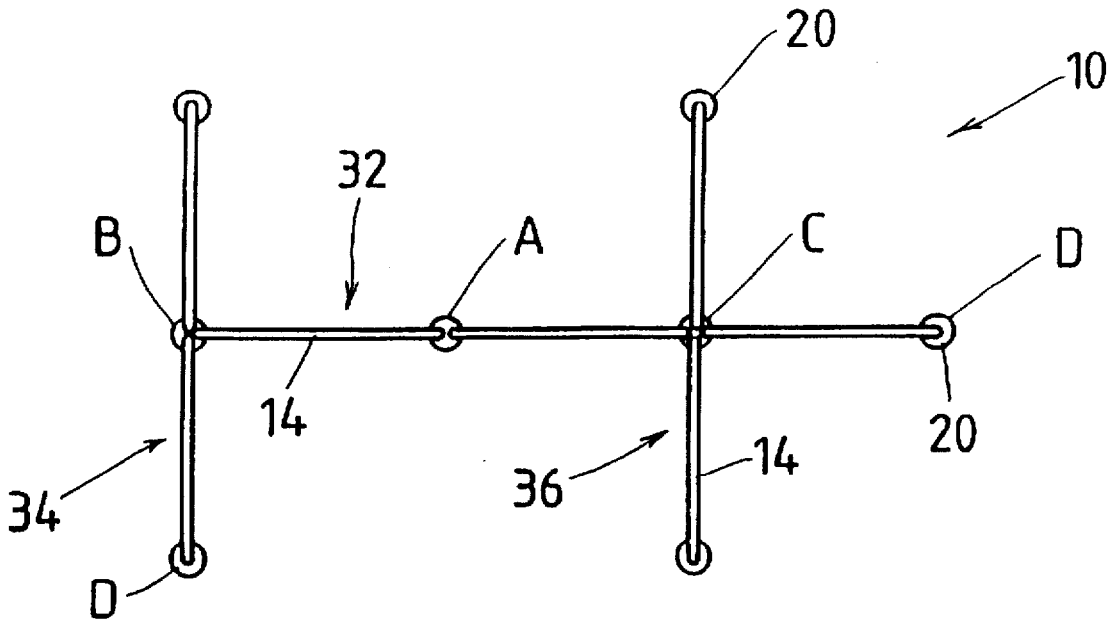
FIG. 2 is a plan of the stand of the invention.
Figure 9A:
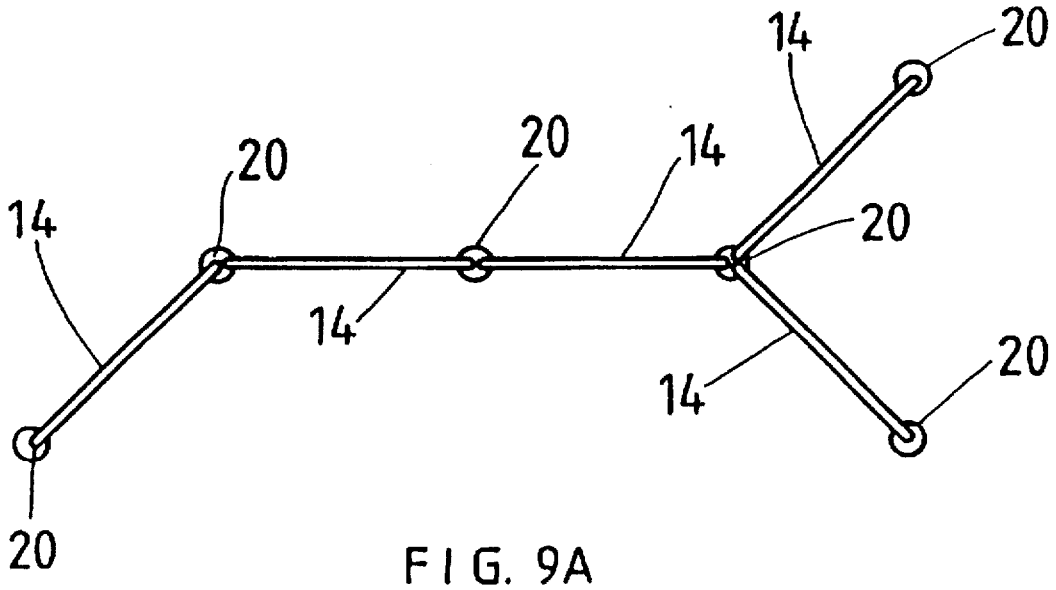
Figure 9B:
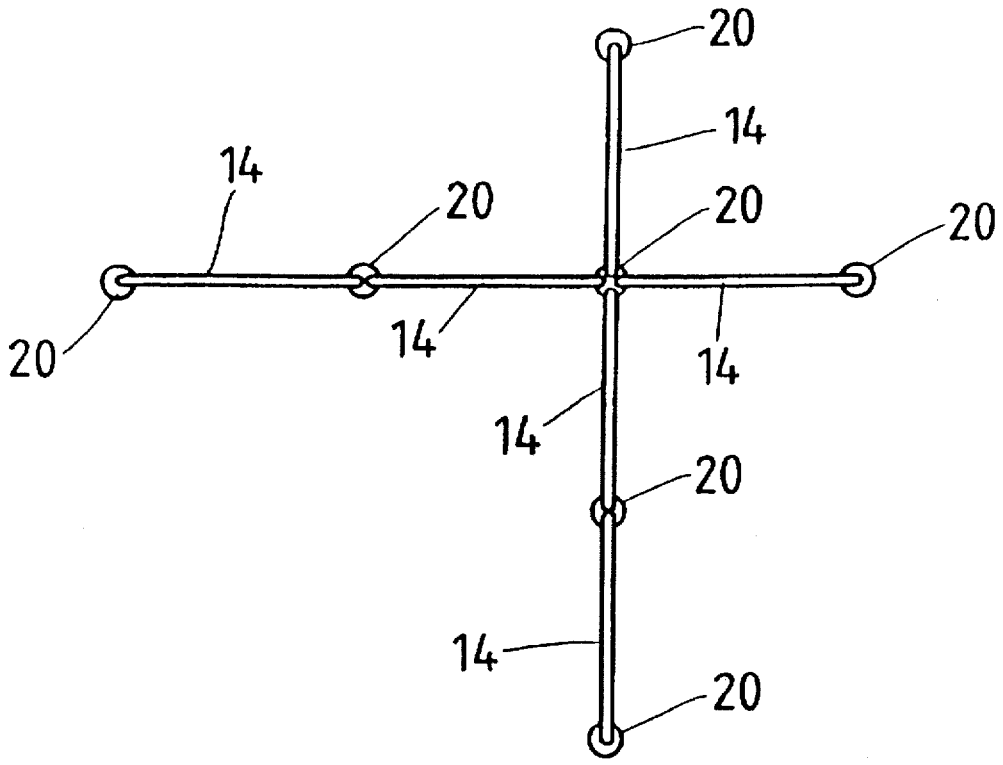
Figure 9C:
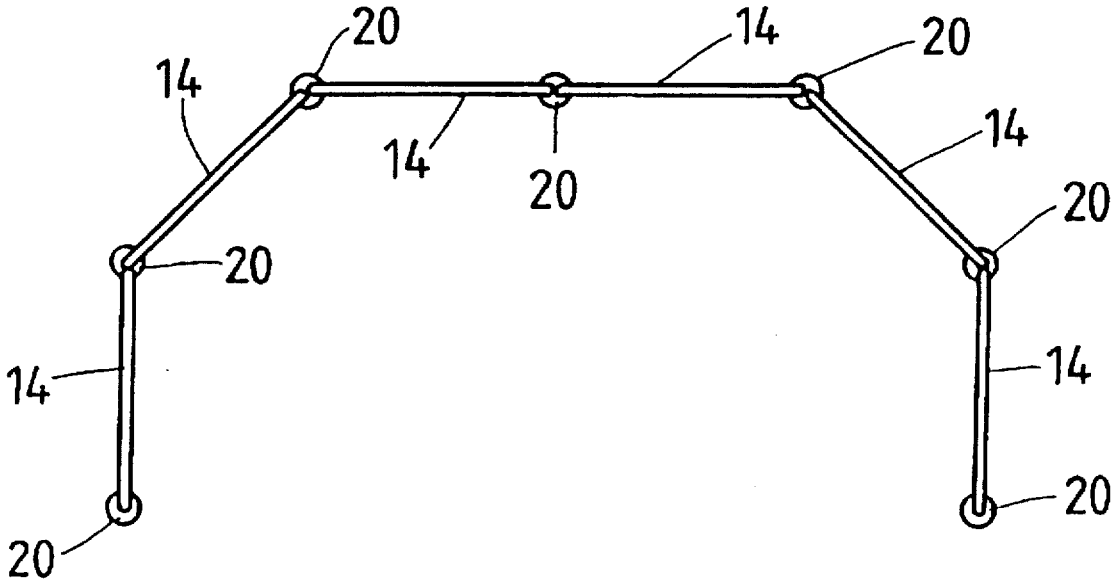

Referring now to FIGS. 1 and 2 there is shown a demountable exhibition stand 10 of the invention. The stand 10 comprises a plurality of panels 14 mounted vertically in vertical columns 16 and horizontal rows 18. The stand 10 is carried on a plurality of feet 20 located below the position where the adjacent columns 16 meet.

The panels

Figure 3:
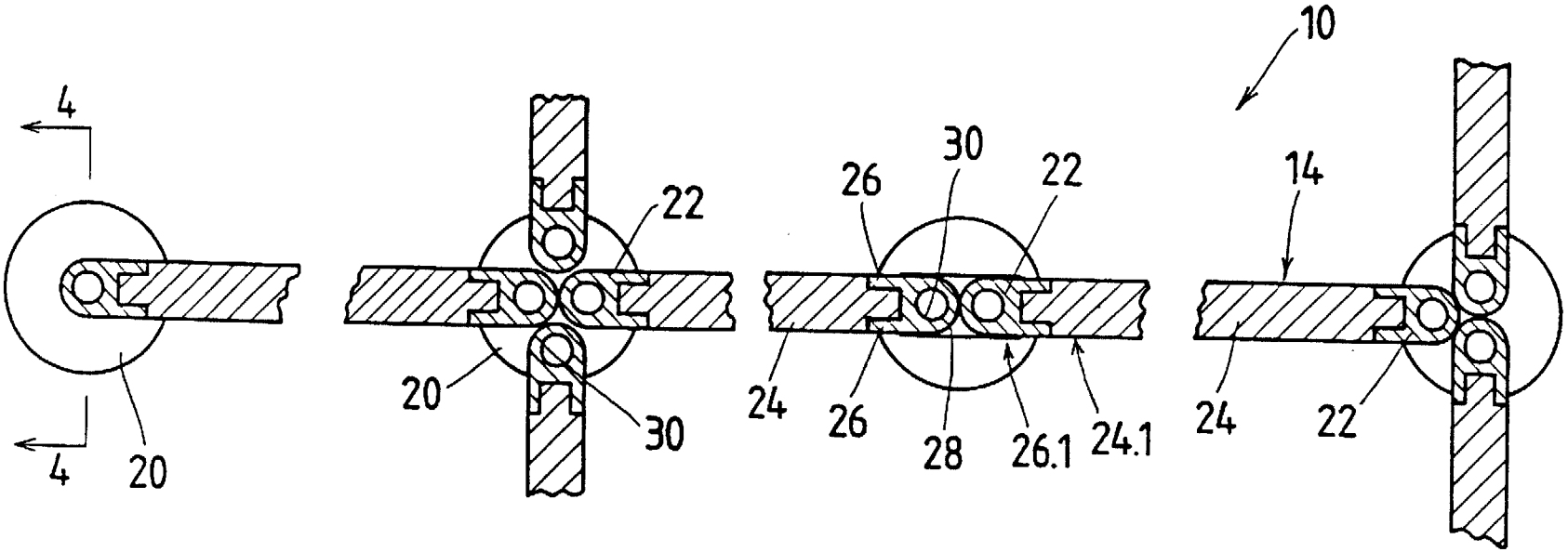
FIG. 3 is a detail section on line 3—3 of FIG. 1.

Each panel 14 comprises a pair of vertical edging members 22 and a panel part 24 therebetween (see FIG. 3). The panel part 24 may comprise a pressed board plate but preferably comprises a pair of side that may comprise plastic plates or metal plates the outside faces of which are enamelled and that are joined by a honeycomb structure to be of light weight. The edging members 22 each comprise an extruded aluminum channel member having a pair of side pieces 26 and a hemi-cylindrical end part 28. A wholly enclosed circular section opening 30 which is co-axial with the end part 28 runs the full length of the edging member. The facing inside surfaces of the side pieces 26 are smooth.

The vertical edges of the panel parts 24 are recessed to be able to fit tightly between the side pieces 26 with the outside surfaces 26.1 of the edging members 22 lying flush with the faces 24.1 of the panel part 24. The colouring of the exterior on the side pieces 26 and the panel part 24 may be the same so that each panel 14 gives the appearance of a unitary member.

The dimensions of the face of each panel 14 are conveniently 640×590 mm. The thickness of the panels is 13 mm. However the panels can be of any size suitable for the purpose.

The arrangement of the stand

The stand 10 is arranged so that in plan (as shown in FIG. 2) there is a main surface portion 32 with two columns 16 of panels 14 aligned, an end portion 34 in the form of a "T"-piece and a cross-portion 36 at right angles to and extending on either side of the columns of the main portion 32. It will be seen that (a) where the columns 16 of panels 14 are aligned with no additional adjacent columns, there are two panels 14 close to one another at the join A between the columns of panels, (b) where there is a "T"-piece there are three columns of panels close to one another at the join B between the columns of panels, and (c) where there is a cross-piece there are four columns of panels close to one another at the join C between the columns of panels. Furthermore at the free end of each panel of a row there is a position D there is only a single edging member.

The connector units

The panels are connected together by connector units 38. Each connector unit 38 comprises an intermediate or connector member 40 made from steel plate and a number of pins 42. The connector units are of different forms 38A, 38B and 38C located respectively at the various joins A, B and C as will be described below. Except at the upper ends of the columns of the stand, the pins 42 project from both sides of the connector or intermediate members 40.

Figure 4:
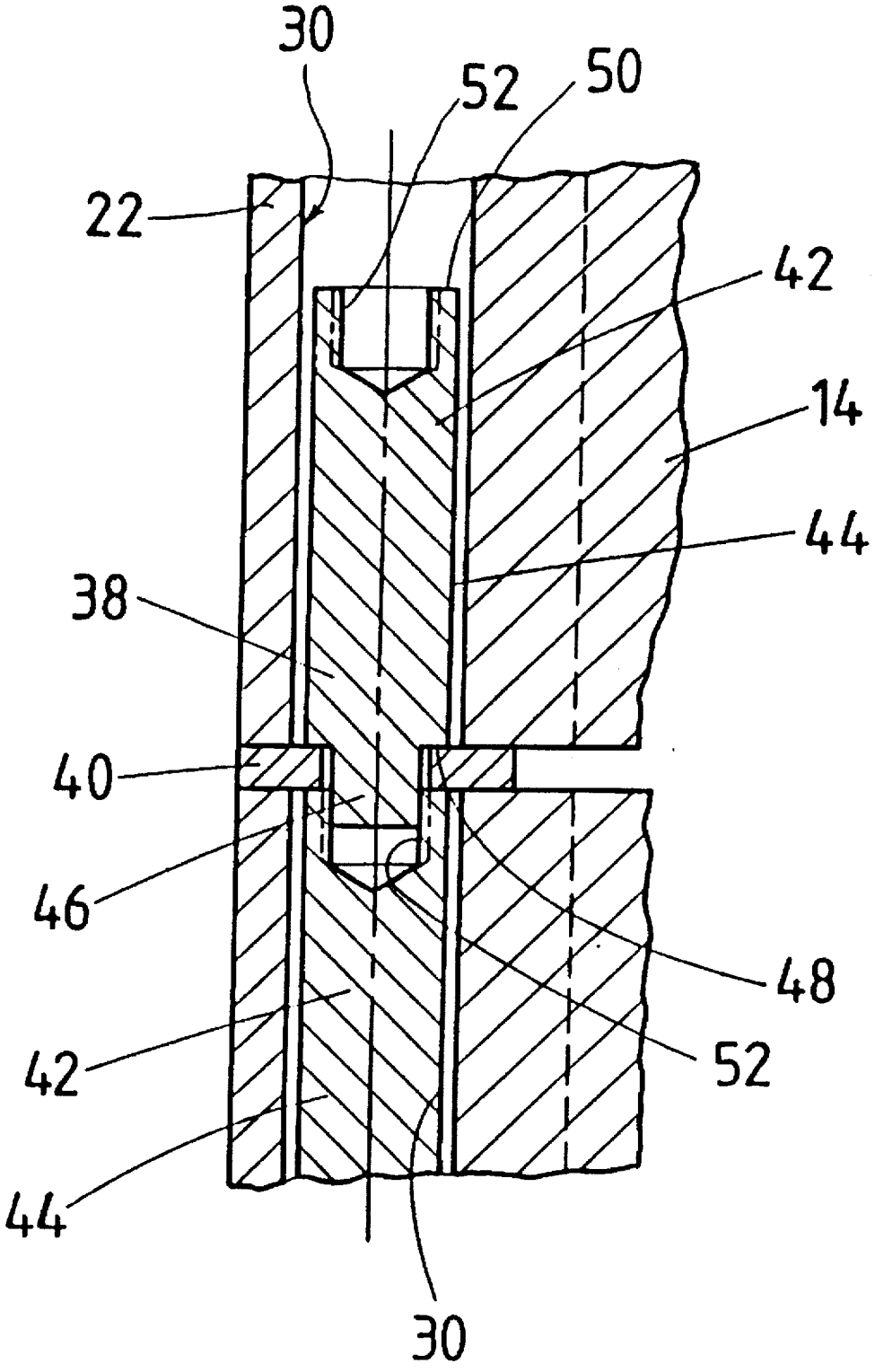
FIG. 4 is a detail longitudinal section on line 4—4 of FIG. 3.

The panels of each column are joined together by pins 42 which fit into the lower portion of the opening 30 in the upper panel and into the upper portion of the opening 30 of the lower panel (as is best illustrated in FIG. 4).

The pins

Each pin 42 is a two part member, the parts 44 being identical. Each part 44 is cylindrical with a co-axial threaded portion 46 of smaller diameter projecting from an end shoulder 48 which extends at right angles to the axis of the part 44. At its other end, the part 44 has an end shoulder 50 extending at right angles to its axis and a co-axial threaded blind bore 52 into which is threadedly received the portion 46 of another pin part. The pin parts 44 are tightly threaded together (as discussed below) and clamp an intermediate member 40 between the shoulders 48 and 50. The dimensions of each pin parts 44 are as follows:—the axial length of the cylindrical body (i.e. the length between the two shoulders 48 and 50) is 40 mm, its diameter is 9 mm. The threaded portion 46 is 10,6 mm long and of 5,75 mm diameter. The dimensions of the bore 52 are such the threaded portion 46 of another pin part can be received therein.

The intermediate members

The intermediate or connector members 40 are all of the same thickness which is sufficient for the purpose that will be described below and which is conveniently 3 mm.

The intermediate or connector member 40A (see FIG. 5A) for use at join A has two generally semi-circular end portions 54A which have therein coaxial cylindrical openings 56A therein through which can pass the threaded portions 46. Between the end portions 54B there is a short and narrow middle piece 58A having parallel sides spaced apart by twice the radius of the end portions.

The intermediate or connector member 40B (see FIG. 5B) for use at join B has three generally semi-circular end portions 54B which have coaxial openings 56B that are eguispaced from one another. A T-shaped middle piece 58B joins these end portions 54B. The leg 58B.1 and cross-piece of the piece 58B are of the same width as the middle piece 58A.

The intermediate or connector member 40C (see FIG. 5C) for use at the join C is generally of the same shape as the member 40B with an aligned second projecting leg 58C.2 on the side of the cross-piece. The member 40C has four generally semi-circular end portions 54C that have coaxial openings 56C.1, 56C.2, 56C.3 and 56C.4 therein. The openings are arranged with their axes at the apices of an equilateral parallelogram formed by two equilateral triangles. Thus the axes of the openings of each triangle (i.e. respectively openings 56C.1, 56C.2 and 56C.3 and openings 56C.1, 56C.2 and 56C.4) are equispaced from one another by the same amount and the axes of the openings at the remote apices 56C.3 and 56C.4 of the triangles are spaced at about 1,73 times the distance between the other openings. The connector further comprises a middle piece 58C joining the end portions 54C which is in the shape of an asymmetrical cross, the arms of which are parallel sided and as wide as the middle piece 58A.

The intermediate member 40D (see FIG. 6) for use with the pin 42 for connecting together at the free outer ends of the end panels of each row is annular and comprises a circular portion 54D with a co-axial opening 56D therein.

The circular portions 54 are all have a radius slightly less than that of the end part 28 of the edging member and thus are no thicker than the panel 14. The adjacent openings 56 are 6 mm in diameter and the axes of the openings are all 14 mm distant from one another (except for the axes of the openings 56C.3 and 56C.4 which are 22,5 mm distant from one another).

Thus (a) the intermediate members 40A will connect together two pins 42 and thus two columns of panels where they meet, (b) the intermediate members 40B will connect together three pins and thus three columns of panels and (c) the intermediate members 40C will connect together four pins and hence four columns of panels.

The intermediate members 40 will in addition act as a stop to prevent the pins 42, especially those at positions D, falling into the lower opening 30.

At the top end of the columns a flat headed bolt 62 passes through each of the openings 26 to engage in the threaded bore 52 of the pin part 42 below the intermediate member 40. In this way the upper ends of the panels in the uppermost row will be connected together.

Furthermore if it is desired to omit one of the panels of say the uppermost row (as is shown in FIG. 1) for an aesthetic or other reason, then a bolt 62 will engage the pin part 44 therebelow through an opening of the intermediate member 40, a pin part 44 engaging the intermediate member through the or each other opening so that the connector part can be secure and rigid.

The feet

Each foot 20 comprises two parts, viz a lower part 62 and an upper part 64 (see FIGS. 7 and 8). The lower part 62 comprises a hollow internally threaded cylindrical body 66 with a thick body wall and a small outer flange 68 for increased ground contact. The upper part 64 comprises a head 70 from which depends a substantial co-axial threaded part 71 that threadedly engages in the threaded bore of the body 66.

The head 70 has four openings 74.1, 74.2, 74.3 and 74.4 therethrough arranged in the same disposition as the openings 56C in the intermediate member 52C. Each opening 74 is internally threaded to receive the threaded portion 46 of a pin 42.

Erection of the stand

To erect the stand 10, the feet 20 are placed at the predetermined locations corresponding to joins A, B and C and positions D. The appropriate number of pin parts 44 are threaded into the openings 74 in the heads of the feet and threadedly connected thereto. If there are two such pin parts 44, these will be inserted into the openings 74.1 and 74.2. If there are three such pin parts they will be inserted in openings 74.1, 74.2 and 74.3 (or 74.4) so that the pin parts are all equidistant.

A panel 14 ("the first panel") is mounted between two adjacent pairs of feet 20 with the pin parts 44 engaging in the openings 30 of the edging members. An adjacent panel ("a second panel") is now mounted at the join with the first panel. A second of the pin parts 42 of the foot 20 engages in the opening 30 of one edging member 22 of the second panel and a pin part from the adjacent foot engages in the opening 30 of the other edging member of the second panel.

If the join is a join B or C, then one or more additional second panels will be mounted in a similar way on the appropriate feet 20.

The connector units 38 are now formed by screwing together the pin parts clamping the intermediate members therebetween. The lower pin parts of the connector units engage in the upper ends of the openings 30 in the edging members 22 at the various joins. The panels are now firmly secured to one another by the feet 20 and the connector units 38. For stability it is desirable that the first two columns of panels erected are at a join B or C or where the panels are in planes inclined to one another. The remaining panels of the first row are all positioned and connected in the same way. The openings 30 in the outer edging members 22 of the panels of the outer columns receive the pin parts of connector units 38D comprising a single pin 42.

The next row of panels is now mounted in the same way and the entire stand is erected similarly. As mentioned above at the topmost panels of each column, the connector member is comprised by an intermediate member 40, a pin part 44 therebelow and a bolt 62 having its shank passing through the opening 56 and engaging into the threaded bore 52 of the pin part 44.

Dismounting of the stand will take place in the reverse order.

General

I have found that the stand 10 as above described is firm and rigid.

I have found too that the pin parts 44 need only be finger tight in their connection without adversely affecting the rigidity and firmness of the stand.

In addition I have found that the stand is pleasing aesthetically as the connector units are not intrusive. In particular if the connector units comprise intermediate members appropriate to the joins, these intermediate members will not project beyond the surfaces of the panels. Even where there is such projection, it will not be prominent or obtrusive.

The thickness of the intermediate members 40 is such as to ensure that the panels of a column are spaced slightly apart from one another. The consistent spacing between rows of panels is aesthetically very acceptable. The spacing is sufficient to permit a conventional catalogue tray (not shown) to be hooked on to the lower of the panels. Lighting units (also not shown) may be hooked on to the uppermost of the panels in the columns to illuminate the exhibition stand.

It will be seen that as a panel 14 can pivot about a pin 40 the inclination of a column of panels to an adjacent column of panels can be varied as desired. Furthermore it will be appreciated that should there be any irregularity in the surface on which the exhibition stand is mounted, this can be compensated for by rotating the lower part 64 of selected feet 20 to vary the axial length of the feet.

The exhibition stand can be erected in any form. Typical patterns are shown in FIG. 9.

It will be appreciated that the connector units of the invention can be stored and transported in the disassembled form. This not only dramatically reduces the volume needed to store the units. Furthermore the same pins 42 can be used with all connector units 38. This together with the aforementioned feature also provides for greater flexibility in assembling the connector units for any particular configuration of exhibition stand.

It will also be seen that the distance between the closest portions of the end parts 28 of the edging members 22 of adjacent panels can be extremely close together. In the embodiment as described this distance will be 1 mm. However by moving the openings slightly closer to one another the distance can be reduced to 0.5 mm. Furthermore it will be seen that where the connector 54C is used, all the panels will be close together. If a panel secured to a pin in an opening 56C.3 or 56C.4 is removed, the remaining panels will remain in the same close proximity.

A connector having more openings than the number of panels to be used at a join may be used at such join.

The invention is not limited to the precise constructional details hereinbefore described and illustrated in the accompanying drawings. In particular the various dimensions mentioned in the specification can be varied in a manner apparent to those skilled in the art. The connector units may be pre-formed prior to the erection of the stand. The spirit and scope of the invention is defined solely by the appended claims.

I claim:

1. An exhibition stand comprising:

a plurality of panels, each panel having vertical and transverse side edges and openings at the upper and lower ends of the vertical side edges, the panels being arranged in adjacent vertical arrays with the vertical side edges of the panels in an array being aligned and with the transverse side edges of the panels in adjacent arrays being aligned, and a plurality of connector units connecting together the panels, at least some of the connector units comprising an intermediate member having a plurality of apertures therethrougb and at least two pins projecting therefrom, each pin comprising two pin parts, one of said pin parts having a projecting threaded member that passes through one of said apertures and the other said pin parts has a threaded bore into which said threaded member is threadedly received.

2. An exhibition stand as claimed in claim 1 comprising feet located below the positions at which the columns meet, the feet each having a head with four apertures formed therein and at least one of said apertures receiving a pin part of a connecting unit said apertures being arranged at the apices of an equilateral parallelogram the sides of which are the same length as the shorter diagonal of the parallelogram.

3. An exhibition stand as claimed in claim 2 in which the apertures are threaded and said pin part has an externally threaded lower portion, and in which said threaded lower portion is threadedly received within said threaded aperture.

4. An exhibition stand as claimed in claim 1 wherein the two pin parts constituting a pin are identical.

5. An exhibition stand comprising:

a plurality of panels, each panel having vertical and transverse side edges and openings at the upper and lower ends of the vertical side edges, the panels being arranged in three adjacent vertical arrays with the vertical side edges of the panels in an array being aligned, and with the transverse side edges of the panels in adjacent arrays being co-planar, a plurality of connector units connecting together said plurality of panels, at least some of the connector units comprising an intermediate member having therethrough three apertures which apertures being arranged at the apices of an equilateral parallelogram the side of which are the same length as the shorter diagonal of the parallelogram and three pins projecting therefrom, each pin comprising two pin parts, one of which pin parts includes a projecting threaded member that passes through one of said apertures and the other of which pin part has a threaded bore into which said threaded member is threadedly received.

6. An exhibition stand comprising:

a plurality of panels, each panel having vertical and transverse side edges and openings at the upper and lower ends of the vertical side edges, the panels being arranged in four adjacent vertical arrays with the vertical side edges of the panels in an array being aligned, and with the transverse side edges of the panels in adjacent arrays being co-planar;

a plurality of connector units connecting together the panels, at least some of the connector units comprising an intermediate member having therethrough four apertures, said apertures being arranged at the apices of an equilateral parallelogram the sides of which are the same length as the shorter diagonal of the parallelogram and four pins projecting therefrom, each pin comprising two pin parts, one of which pin parts constitutes a projecting threaded member that passes through one of said apertures and the other of which pin parts has a threaded bore into which said threaded member is threadedly received.

7. An exhibition stand comprising:

a plurality of panels, each panel having vertical and transverse side edges and openings at the upper and lower ends of the vertical side edges, the panels being arranged in four adjacent vertical arrays with the vertical side edges of the panels in an array being aligned and with the transverse side edges of the panels in adjacent arrays being co-planar, a plurality of connector units connecting together the panels, at least some of the connector units comprising an intermediate member carrying four pins projecting therefrom and being arranged at the apices of an equilateral parallelogram the sides of which are the same length as the shorter diagonal of the parallelogram, wherein each pin comprises a pair of aligned pin parts of substantially the same cross-section projecting from opposite sides of the intermediate member, feet located below the intermediate members, the feet each comprising a ground engaging base member and an upper member, said base member and upper member having inter-engaging threaded parts so that on relative rotation therebetween the axial length of the foot will change and having an upper member with four apertures formed therein and at least one of said apertures receiving a pin part of a connector unit, said apertures being arranged at the apices of an equilateral parallelogram the sides of which are the same length as the shorter diagonal of the parallelogram.

* * * * *